US009394758B2

(12) United States Patent
Landrith, II et al.

(10) Patent No.: US 9,394,758 B2
(45) Date of Patent: Jul. 19, 2016

(54) SEALABLE WELLSITE VALVE AND METHOD OF USING SAME

(71) Applicant: National Oilwell Varco, L.P., Houston, TX (US)

(72) Inventors: James Ray Landrith, II, Humble, TX (US); Matthew Christopher Quattrone, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/252,481

(22) Filed: Apr. 14, 2014

(65) Prior Publication Data

US 2014/0326459 A1 Nov. 6, 2014

Related U.S. Application Data

(60) Provisional application No. 61/819,003, filed on May 3, 2013.

(51) Int. Cl.

| | |
|---|---|
| ***F16K 1/42*** | (2006.01) |
| ***F15B 13/042*** | (2006.01) |
| ***F16K 31/124*** | (2006.01) |
| ***F16K 43/00*** | (2006.01) |
| ***E21B 34/02*** | (2006.01) |
| ***E21B 34/04*** | (2006.01) |
| ***E21B 43/013*** | (2006.01) |

(52) U.S. Cl.

CPC ..... *E21B 34/02* (2013.01); *E21B 34/04* (2013.01); *E21B 43/013* (2013.01)

(58) Field of Classification Search

None

See application file for complete search history.

(56) References Cited

U.S. PATENT DOCUMENTS

| | | | | |
|---|---|---|---|---|
| 4,011,892 | A | 3/1977 | Kowalski | |
| 4,836,243 | A | 6/1989 | Ferrell | |
| 5,398,761 | A | 3/1995 | Reynolds et al. | |
| 5,409,040 | A | 4/1995 | Tomlin | |
| 5,778,918 | A * | 7/1998 | McLelland ..... | E21B 33/0355 137/15.02 |
| 6,622,799 | B2 | 9/2003 | Dean | |

(Continued)

FOREIGN PATENT DOCUMENTS

WO 2012/037173 3/2012

OTHER PUBLICATIONS

PCT/US2014/034041 International Search Report and Written Opinion dated Jun. 23, 2015, 11 pages.

(Continued)

*Primary Examiner* — Matthew R Buck
*Assistant Examiner* — Douglas S Wood
(74) *Attorney, Agent, or Firm* — JL Salazar Law Firm

(57) ABSTRACT

A valve, system and method for controlling flow of fluid about a wellsite component of a wellsite are provided. The wellsite component has a flowline to pass the fluid therethrough. The valve includes a valve housing, a cage having holes therethrough positionable in selective fluid communication with the flowline, a valve plate operatively connectable between the valve housing and the cage (the valve plate having a sealing surface thereon), and a spool assembly comprising a spool slidably positionable in the cage. The spool assembly is selectively positionable in sealing engagement with the sealing surface of the valve plate to define a sealing interface therebetween, and is movable between an inlet position defining a fluid intake path and an outlet position defining a fluid outtake path whereby the fluid is selectively diverted through the wellsite component.

38 Claims, 14 Drawing Sheets

(56) References Cited

U.S. PATENT DOCUMENTS

| | | | |
|---|---|---|---|
| 6,755,261 | B2 | 6/2004 | Koederitz |
| 7,367,396 | B2 | 5/2008 | Springett et al. |
| 8,220,773 | B2 | 7/2012 | Gustafson |
| 2003/0131884 | A1 | 7/2003 | Hope et al. |
| 2004/0107991 | A1 | 6/2004 | Hollister et al. |
| 2006/0191777 | A1 | 8/2006 | Glime |
| 2007/0102042 | A1 | 5/2007 | Thrash, Jr. et al. |
| 2010/0084588 | A1 | 4/2010 | Curtiss, III et al. |
| 2010/0154896 | A1 | 6/2010 | Thrash, Jr. et al. |
| 2011/0073793 | A1 | 3/2011 | Allen |
| 2011/0120734 | A1 | 5/2011 | Dietz et al. |
| 2011/0198524 | A1 | 8/2011 | Wood et al. |
| 2011/0266003 | A1 | 11/2011 | Singh et al. |
| 2012/0111572 | A1 | 5/2012 | Cargol, Jr. |
| 2012/0222760 | A1 | 9/2012 | Marica |
| 2013/0081823 | A1 | 4/2013 | Wood |
| 2013/0146303 | A1 | 6/2013 | Gustafson |
| 2013/0313449 | A1 | 11/2013 | Weir et al. |
| 2013/0319557 | A1 * | 12/2013 | Smith, III ..... F16K 1/42 137/625.66 |

OTHER PUBLICATIONS

Januarilham, Yahya, "Analysis of Component Critically in the Blow-out Preventer", XP055155092, Jun. 14, 2012, [retreived on Nov. 26, 2014], [retreived from Internet URL: http://brage.bibsys.no/xmlui/bitstream/handle/11250/182183/Januarilham,%20Yahya.pdf?sequence=1], 151 pages.

International Search Report for PCT Patent No. PCT/US2014/043718 dated May 12, 2014, 5 pages.

International Preliminary Report on Patentability for PCT Patent Application No. PCT/US2014/034041 dated Nov. 3, 2015, 7 pages.

Examination Report for EP Patent Application No. 14728367.5 dated Dec. 10, 2015, 2 pages.

* cited by examiner

SEALABLE WELLSITE VALVE AND METHOD OF USING SAME

CROSS-REFERENCE TO RELATED APPLICATIONS

This patent application claims priority to U.S. Provisional Application No. 61/819,003 filed on May 3, 2013, the entire contents of which are hereby incorporated by reference herein.

BACKGROUND

This present disclosure relates generally to valves used in wellsite operations. More specifically, the present disclosure relates to valves, such as hydraulic valves, subsea valves, and/or sub-plate mounted valves.

Various oilfield operations may be performed to locate and gather valuable downhole fluids. Oil rigs are positioned at wellsites, and downhole tools, such as drilling tools, are deployed into the ground to reach subsurface reservoirs. Once the downhole tools form a wellbore (or borehole) to reach a desired reservoir, casings may be cemented into place within the wellbore, and the wellbore completed to initiate production of fluids from the reservoir. Tubulars (or tubular strings) may be provided for passing subsurface fluids to the surface.

In subsea operations, a riser may be provided to fluidly connect the wellhead to a surface platform for passing fluid therebetween. Various devices, such as blowout preventers, lower marine riser packages, manifolds, etc., may be located about the subsea wellhead to perform subsea operations. Valves may be provided about the wellsite to direct the flow of fluid to and from various equipment. Examples of valves are provided in U.S. Pat. No. 5,778,918 and 20110198524.

SUMMARY

In at least one aspect, the disclosure relates to a valve for controlling flow of fluid about a wellsite component of a wellsite. The wellsite component has a flowline to pass the fluid therethrough. The valve includes a valve housing, a cage having holes therethrough positionable in selective fluid communication with the flowline, a valve plate operatively connectable between the valve housing and the cage (the valve plate having a sealing surface thereon), and a spool assembly comprising a spool slidably positionable in the cage. The spool assembly is selectively positionable in sealing engagement with the sealing surface of the valve plate to define a sealing interface therebetween, and is movable between an inlet position defining a fluid intake path and an outlet position defining a fluid outtake path whereby the fluid is selectively diverted through the wellsite component.

The spool assembly may include a piston rod operatively connectable to the spool, the piston rod extending through the valve plate. The valve may also include a pilot piston operatively connectable to the piston rod, the pilot piston slidably positionable in the valve housing. The sealing surface may include at least one groove and/or a notch. An end of the spool may define a key and/or an insert receivable by the notch. The sealing surface and the spool may include metal and the sealing interface may include a metal to metal seal. At least a portion of the sealing surface may be of metal. The valve plate may be modular. The valve housing may have a pressure inlet extending therein, and/or a pilot cavity extending therein from the pressure inlet with the pilot piston slidably positionable in the pilot cavity. The spool assembly may include a piston rod with a pilot piston slidably movable in the pressure inlet.

The valve may also include a spring disposable in the housing about the piston, with the spring urging the spool assembly toward the housing. The spring may include an inner spring and an outer spring. The spool may include a tubular portion having a ring therein to receivably engage the piston rod. The spool may have a flow end selectively positionable in sealing engagement with the cage selectively divert flow through the passage and one of the cage and the spool.

The holes may include at least one inlet, at least one outlet, and a passage therethrough. The cage may have a cage seal therein engageable with the spool to isolate the inlet from the outlet. The fluid intake path may extend in the inlet and out a passage of the cage. The fluid outtake path may extend in the passage and out the outlet. The fluid outtake path may extend in the passage, through the cage, and out the outlet. The fluid intake path may extend in the outlet, through the cage, and out the passage. The valve may also include at least one t-seal, o-ring, and combinations thereof.

In another aspect, the disclosure relates to a hydraulic system of a wellsite. The hydraulic system has fluid flowing therethrough. The hydraulic system includes a wellsite component having a flowline to pass the fluid therethrough and a valve operatively connectable to the flowline. The valve includes a valve housing, a cage having holes therethrough positionable in selective fluid communication with the flowline, a valve plate operatively connectable between the valve housing and the cage (the valve plate having a sealing surface thereon), and a spool assembly comprising a spool slidably positionable in the cage. The spool assembly is selectively positionable in sealing engagement with the sealing surface of the valve plate to define a sealing interface therebetween, and is movable between an inlet position defining a fluid intake path and an outlet position defining a fluid outtake path whereby the fluid is selectively diverted through the wellsite component.

The system may also include a fluid source operatively connectable to the at least one flowline. The wellsite component may be a pod, a low marine riser package, and/or a blowout preventer.

Finally, in another aspect, the disclosure relates to a method of controlling flow of fluid about a wellsite. The wellsite includes a wellsite component include a flowline to pass the fluid therethrough. The method involves operatively connecting a valve to the flowline of the wellsite component. The valve includes a valve housing, a cage having holes therethrough positionable in selective fluid communication with the flowline, a valve plate operatively connectable between the valve housing and the cage, and a spool assembly including a spool. The valve plate has a sealing surface thereon. The method also involves selectively defining a sealing interface between the spool and the sealing surface by slidably positioning the spool in the cage in sealing engagement with the sealing surface of the valve plate, and selectively diverting the fluid through the wellsite component by moving the spool assembly between an inlet position defining a fluid intake path and an outlet position defining a fluid outtake path.

The sealing surface and the spool may include metal and the selectively diverting may involve forming a metal-to-metal seal therebetween. The sealing surface may include a plurality of grooves and the selectively diverting may include sealingly engaging the spool with the grooves. The sealing surface may include a notch and the selectively diverting may involve receivingly engaging a sealing end of the spool in the groove. The operatively connecting may involve operatively connecting together a plurality of portions of the valve plate. The method may also involve urging the piston to a pilot end of the housing. The selectively diverting may involve passing the fluid in the at least one inlet and out a passage of the cage, passing the fluid in the passage and out the at least one outlet, passing the fluid in the passage, through the cage, and out the at least one outlet, and/or passing the fluid in the at least one outlet, through the cage, and out the passage. The method may also involve activating at least one additional wellsite component.

BRIEF DESCRIPTION DRAWINGS

So that the above recited features and advantages can be understood in detail, a more particular description, briefly summarized above, may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

FIG. 6C is a cross-sectional view of the valve plate of FIG. 6B taken along line 6C-6C.

DETAILED DESCRIPTION

Figure 1:
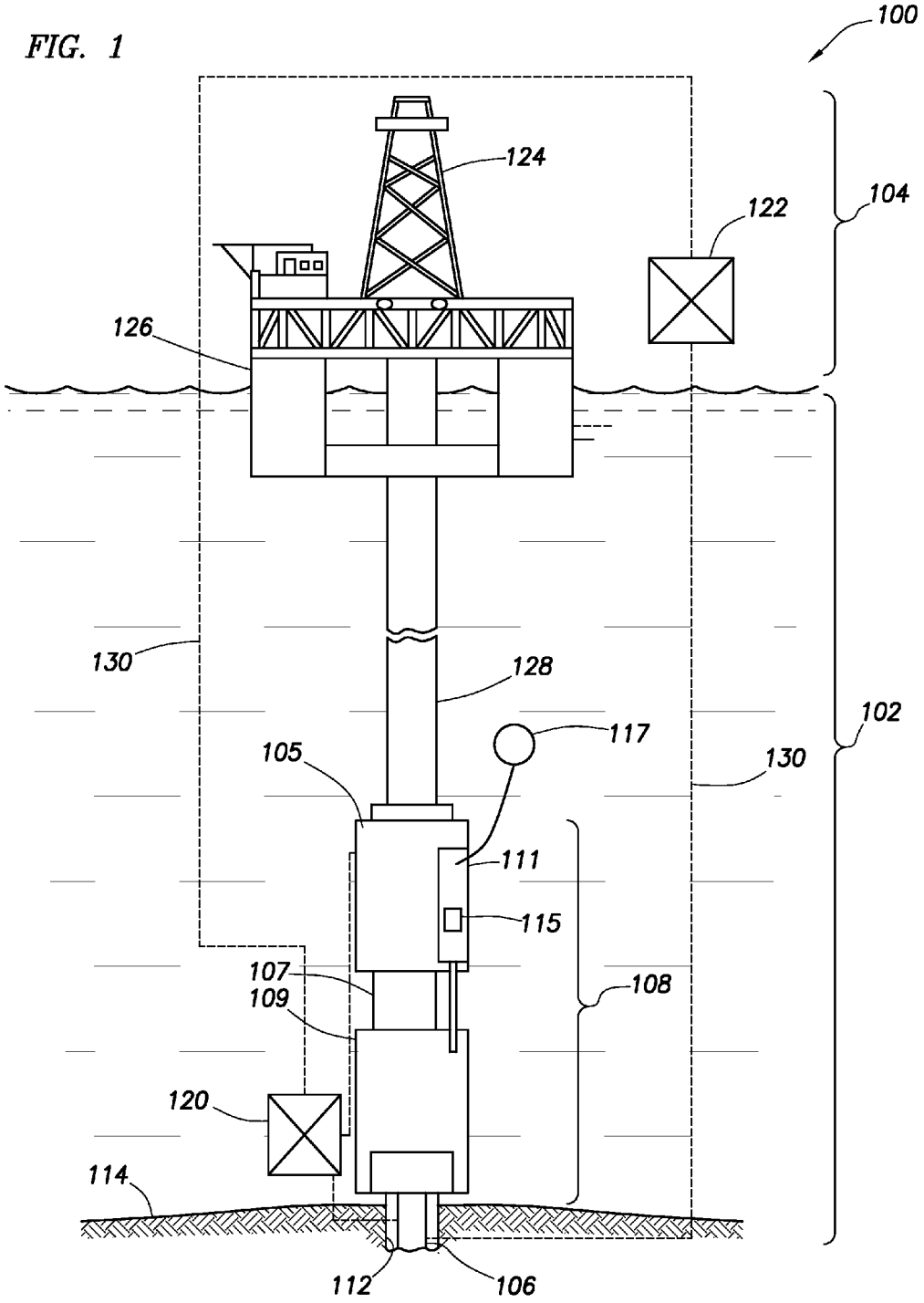
FIG. 1 is a schematic view of an offshore wellsite having a subsea assembly including a lower marine riser package with sealable valves.

The description that follows includes exemplary apparatuses, methods, techniques, and/or instruction sequences that embody techniques of the present subject matter. However, it is understood that the described embodiments may be practiced without these specific details.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the subject matter. In addition, like or identical reference numerals may be used to identify common or similar elements.

A sealable valve is provided for selectively directing fluid about a component, such as a low marine riser package (LMRP), a pod, a blowout preventer, pumps, stacks, and/or other wellsite component, having fluid flowing therethrough. The valve may be, for example, a sub-plate mounted (SPM) valve positionable in a hydraulic (e.g., subsea) component, such as a pod, a low marine riser package (LMRP), and/or a blowout preventer. The valve has a housing, a valve plate, and a cage, with a spool assembly slidably movable therein. The valve plate has sealing portions on an end (or sealing surface) thereof sealingly engageable with an end of a spool of the spool assembly to define a plurality of sealing interfaces at pressure points therebetween.

FIG. 1 depicts an offshore wellsite 100 in which the subject matter of the present disclosure may be utilized. The wellsite 100 has a subsea system 102 and a surface system 104. The wellsite 100 is described as being a subsea operation, but may be for any wellsite environment (e.g., land or water based). The subsea system 102 includes a wellhead 106 extending from a wellbore 112 in a sea floor 114, and a wellsite connection assembly 108 thereabove.

The wellsite connection assembly 108 which includes an LMRP 105, a mandrel 107, and a lower stack 109. The LMRP 105 is provided with a pod 111 with at least one sealable valve 115 therein. A subsea controller 120 is provided for operating, monitoring and/or controlling the LMRP 105, the pod 111, the sealable valve 115, the lower stack 109 and/or other portions of the wellsite 100. As schematically depicted, a fluid source 117 may also be provided in one or more locations, such as in the subsea assembly and/or at a surface location.

While FIG. 1 shows a specific configuration of a variety of wellsite components (or devices), one or more blowout preventers, LMRPs, pumps, pods, stacks, or other components and/or combinations thereof, may be provided with one or more sealable valves 115.

The surface system 104 includes a rig 124, a platform 126 (or vessel), a riser (or tubular) 128 and a surface controller 122. The riser 128 extends from the platform 126 to the subsea assembly 108 for passing fluid therethrough. Part (or all of) the riser 128 and/or wellhead 106 may pass through the subsea assembly 108 and provide fluid communication therebetween.

The surface controller 122 may provide for operating, monitoring and/or controlling the rig 124, platform 126 and/or other portions of the wellsite 100. As shown, the surface controller 122 is at a surface location and the subsea controller 120 is at a subsea location (e.g., at the platform 126, a vessel (not shown), or offsite). However, it will be appreciated that the one or more controllers 120/122 may be located at various locations to control the surface 104 and/or the subsea systems 102. Communication links 130 may be provided for communication with various parts of the wellsite 100, such as the controllers 120/122.

Figure 2:
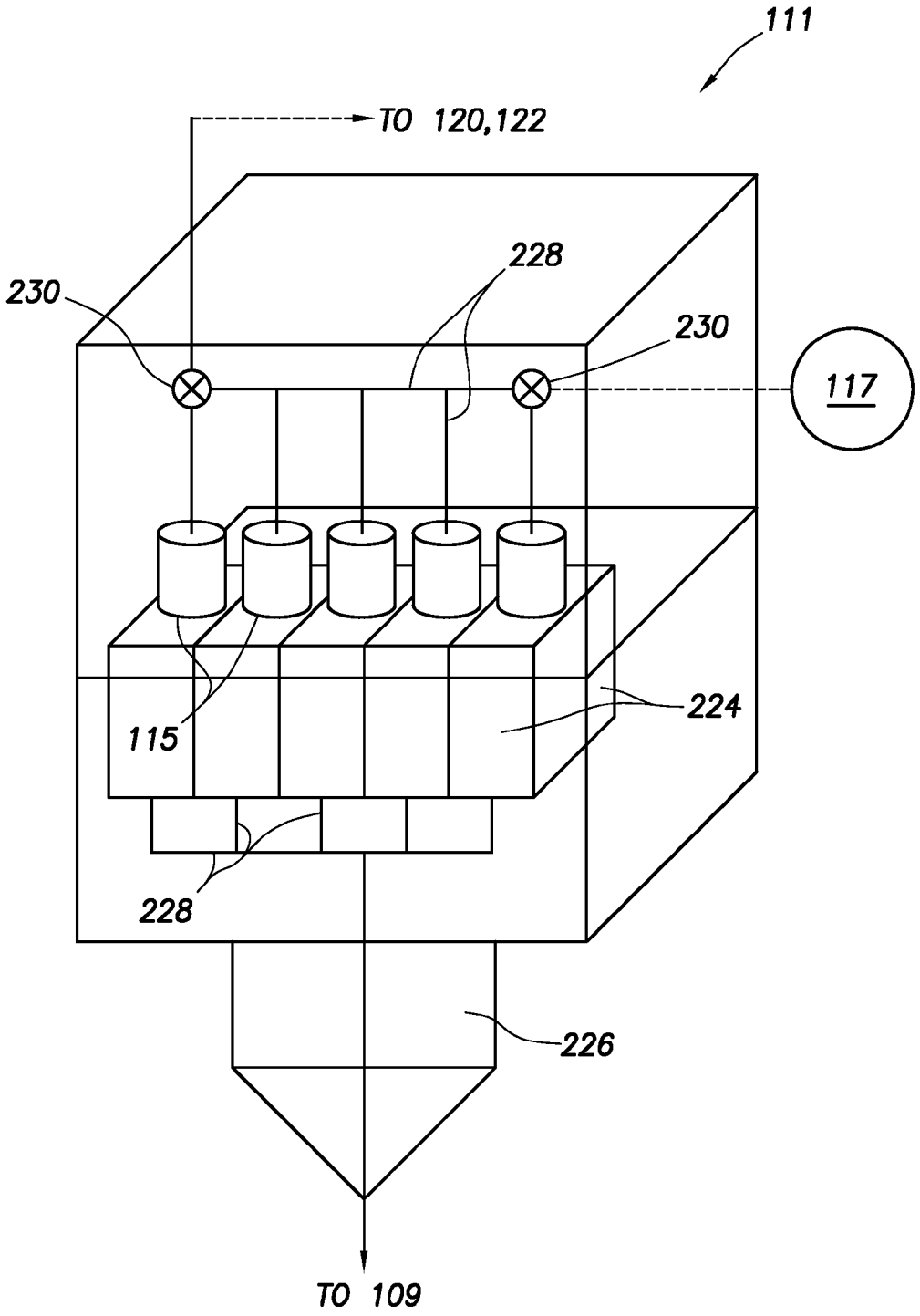
FIG. 2 is a schematic view of a portion of a lower marine riser package and sealable valves.

FIG. 2 depicts an example configuration of a hydraulic component, pod 111 usable with valves 115, 111 the example shown, the pod 111 includes valve blocks 224, a plurality of the sealable valves 115, and a stab 226. The sealable valves 115 are schematically depicted as being coupled to controllers 120, 122 for passing signals (e.g., power, control, etc.) therebetween.

The sealable valves 115 are fluidly connected to the fluid source 117 via flowlines 228 and pilot valves 230. The sealable valves 115 are also fluidly coupled via stab 226 to the lower stack 109 via additional flowlines 228. The fluid source 117 may be used to provide a piloting fluid (or pressurized control fluid) to the pilot valves 230 to pilot the sealable valves 115. The control valves 230 may be, for example, electrohydraulic valves activatable by an electric signal received from the controllers 120/122 (FIG. 2).

Figure 3A:
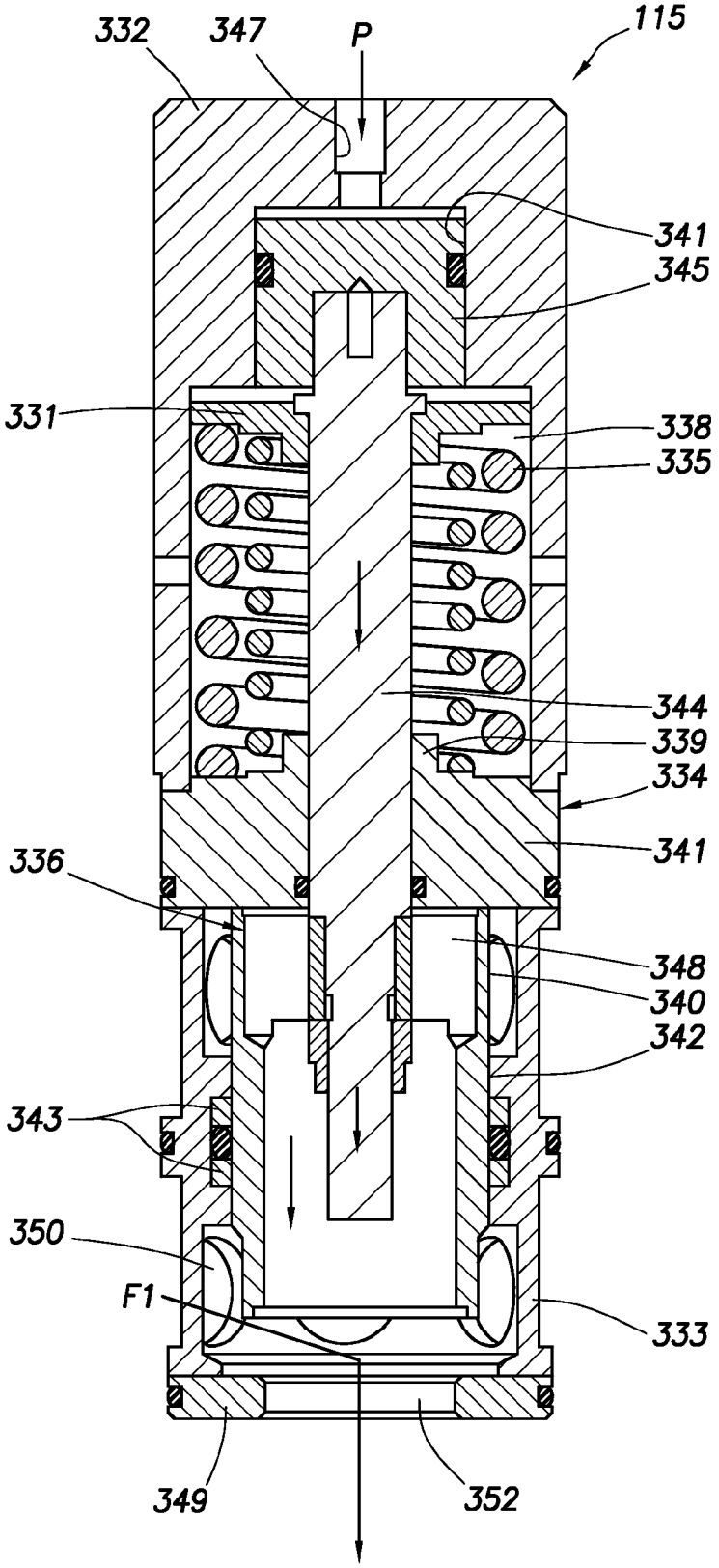
FIGS. 3A and 3B are vertical cross-sectional views of a sealable valve in an open and closed position, respectively.
Figure 3B:
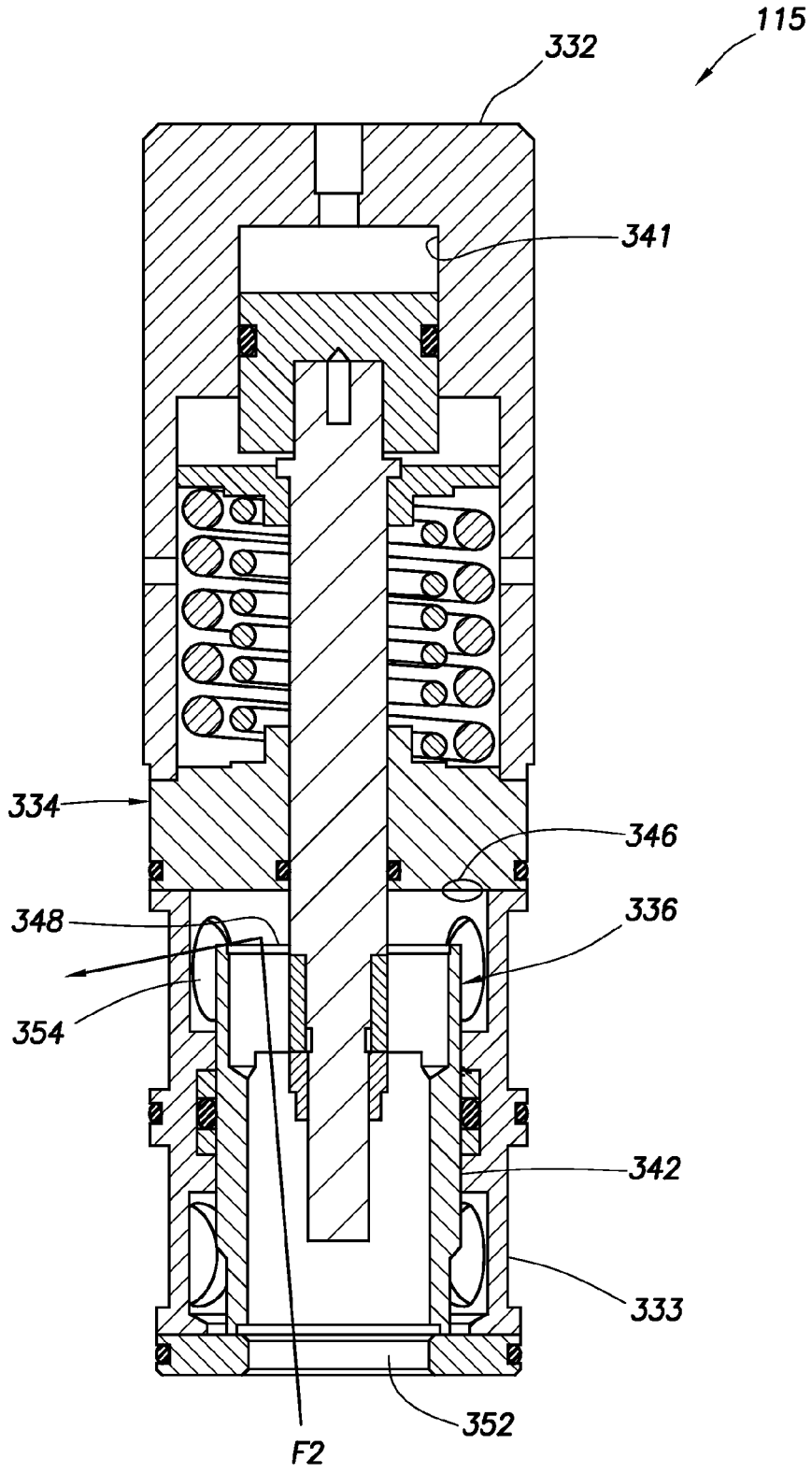
Figure 4:
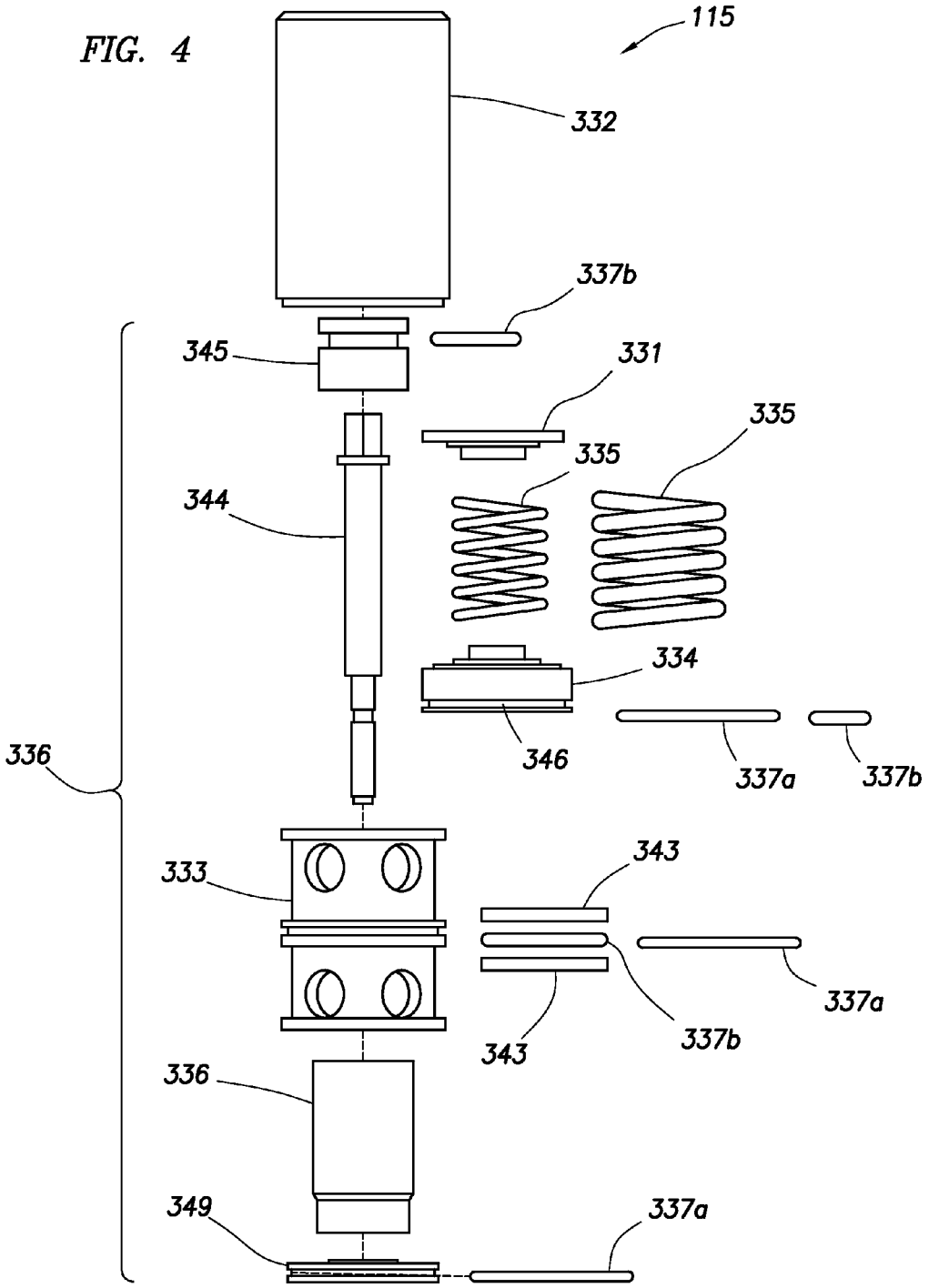
FIG. 4 is an exploded view of the sealable valve of FIG. 3A.

FIGS. 3A and 3B depict cross-sectional views of the sealable valve 115 in an open (or sealed) and closed (or unsealed) position, respectively. FIG. 4 shows an exploded view of the sealable valve 115. As shown in these figures, the sealable valve 115 includes a housing 332, a cage 333, a valve plate 334, a spring 335, and a spool assembly 336. As shown, the sealable valve 115 may also be provided with one or more o-rings 337*a*, t-seals 337*b* and or other sealing devices at various positions about the sealable valve 115 for restricting flow therethrough.

The housing 332 has a spring chamber 338 therein. The cage 333 has a spool chamber 340 therein and a seal plate 334 at an exterior end thereof. The cage 333 is a cylindrical member with a cage plate 349 at an end thereof. The cage has one or more inlets 350 and outlets 354 therethrough. The cage plate 349 has a fluid passage 352 therethrough. Part of the housing 332 and/or another housing portion may be positioned about the cage 333.

The spring 335 is positioned in the spring chamber 338 and pressed against the valve plate 334 by spring retainer 331. As shown, the spring 335 includes an inner portion and an outer portion, but optionally may be unitary. The valve plate 334 is depicted as including a plate head 339 and a plate ring 341. Other optional features may be provided, such as wear bands 343 between the spool assembly 336 and the cage 333.

The spool assembly 336 includes a spool 342, a piston rod 344, and a pilot piston 345. The piston rod 344 extends from the spool 342 through the valve plate 334 and to the pilot piston 345. The piston rod 344 passes from spring chamber 338 through the valve plate 334 and into the spool chamber 340. The piston rod 344 with the pilot piston 345 on an end thereof is slidably movable in the housing 332. The pilot piston 345 is slidably positionable in a pilot chamber 341 in the spring chamber 338. The spool assembly 344 may be selectively moved in the housing 332 by selective application of pressure P (e.g., from fluid source 117 of FIG. 2) to pilot piston 345.

The sealable valve 115 is normally in the open position of FIG. 3A until activated. The spring 335 is positioned between the pilot piston 345 (or spring retainer 331) and the valve plate 334 to urge the spool assembly 336 to the open position of FIG. 3A. Upon activation, the spool 342 moves with the pilot piston 345 via piston rod 344, resulting in the valve 115 resting in the open position of FIG. 3A. The pilot piston 345 is slidably movable in the housing 332 like a piston in a cylinder.

The spool assembly 336 is movable under pressure P applied to the pilot piston 345 from the open (or sealed) position of FIG. 3A to the closed (or unsealed) position of FIG. 3B as indicated by the downward arrows. FIG. 3A shows the pressure P as it is initially applied through a pressure inlet 347 in the housing 332 and into pilot chamber 341 to overcome a force of spring 335 and move the piston 344. FIG. 3B shows an example of the spool assembly 336 after it has been moved by the pressure P applied to the pilot piston 345. Piloting fluid from the fluid source 117 to pilot valves 230 (FIG. 2) may apply the pressure P to drive the pilot piston 345 and thereby the spool 342 from a relaxed state (open position) to an energized state (closed position).

In the open (or pressure) position of FIG. 3A, fluid flows through the inlets 350 and out the fluid passage 352 extending through the cage plate 349 as indicated by arrow F1. The arrow F1 defines a fluid intake path from inlet 350 through fluid passage 352. In the open position, the spool assembly 336 may be selectively positioned to permit fluid to pass through the cage 333, for example, to the stab 226 and on to a component connected thereto as shown in FIG. 2. In the open position, the spool 342 is positioned in sealing engagement with valve plate 341 and a distance from the cage plate 349.

Pressure P may be applied to the pilot piston 345 to move the spool assembly 336 to the closed position of FIG. 3B. In the closed (or vent) position of FIG. 3B, fluid flows in through passage 352, through spool 342 and out outlets 354 extending through the cage 333 as indicated by arrow F2. The arrow F2 defines a fluid outtake path from fluid passage 352, through spool 342 and out outlet 354. Fluid may vent through passage 352 and out the outlets 354. In this closed position, the spool assembly 336 may be selectively positioned to prevent fluid from passing through the cage 333 via inlets 350. In the closed position, the spool 342 is positioned a distance from valve plate 341 and in sealing engagement with the cage plate 349. Removing pressure P from the pilot piston 345 returns the spool assembly 336 to the open position of FIG. 3A.

The spool 342 is positionable adjacent the valve plate 334. The valve plate 334 may be provided with sealing portions 346 on a spool end (or sealing surface) thereof. The spool 342 has an end 348 sealingly engageable with the sealing portions 346 when the spool 342 is positioned adjacent the valve plate 334.

Figure 5B:
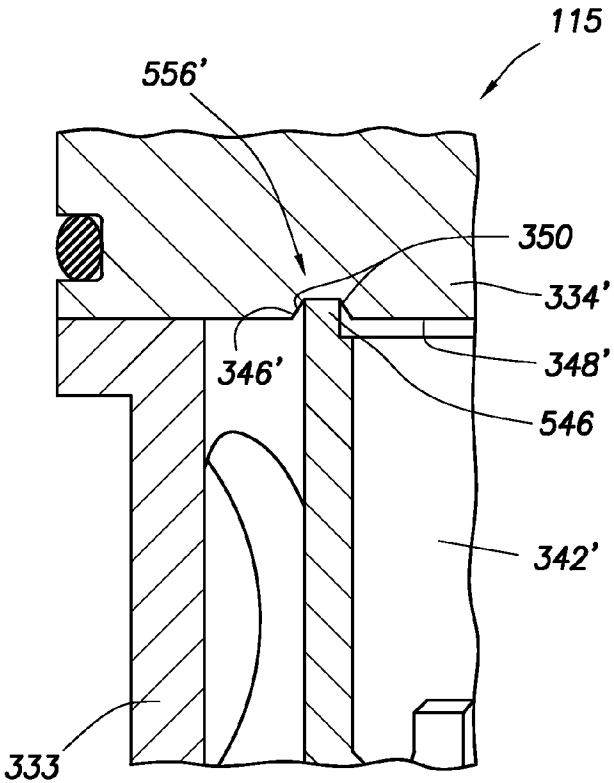
FIGS. 5A-5C are detailed views of a portion of the sealable valve of FIG. 3A depicting various interface configurations between a valve plate and a spool of the sealable valve.
Figure 5A:
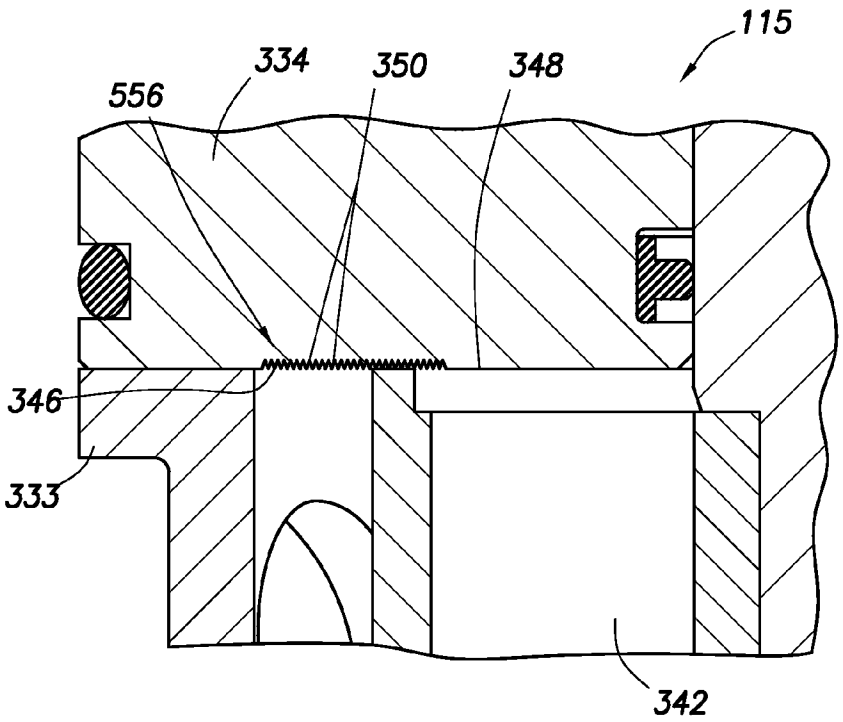
Figure 5C:
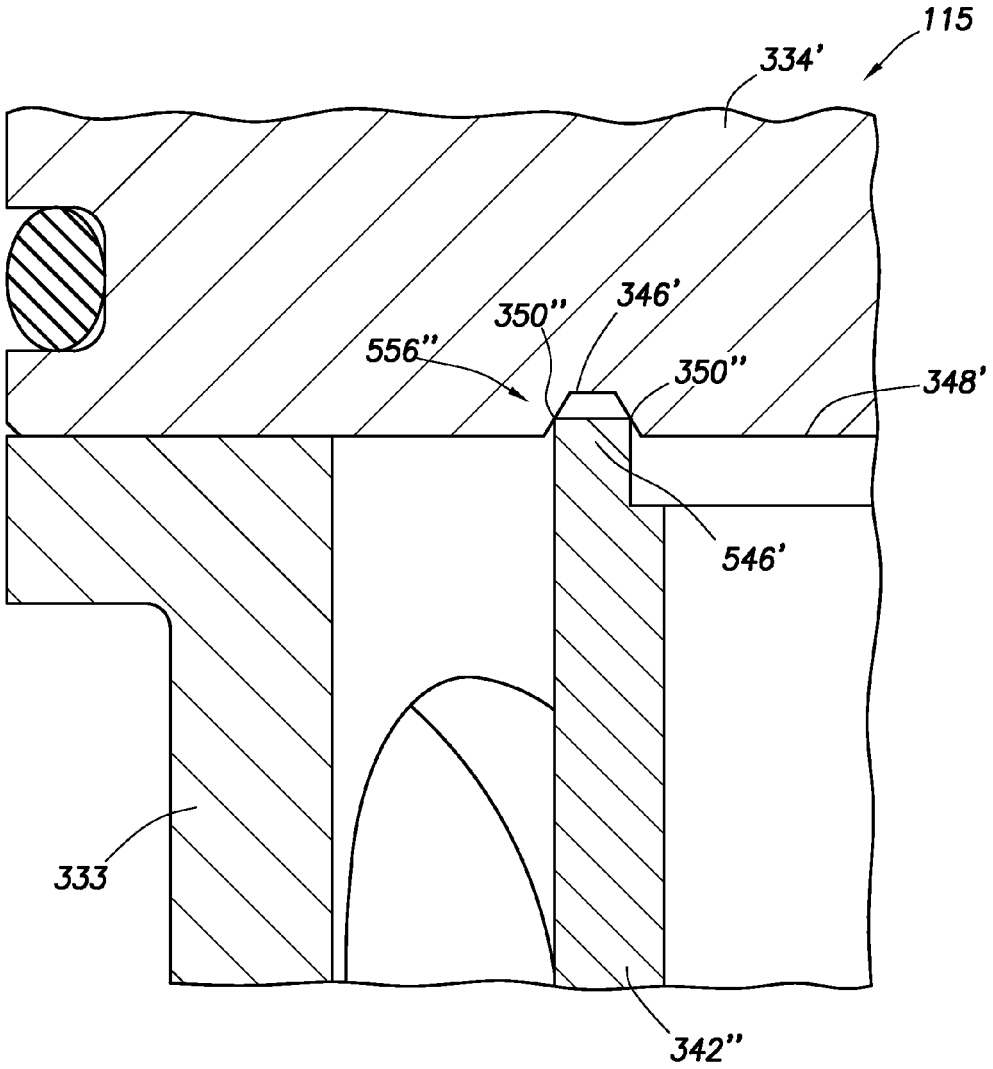

FIGS. 5A-5C depict various configurations of interfaces (or sealing interfaces) 556, 556', 556" of sealable valve 115. FIG. 5A shows a portion of the sealable valve 115 having a groove configuration in greater detail. FIG. 5B shows a portion of the sealable valve 115 with a notch and key configuration. FIG. 5C shows a portion of the sealable valve 115 with a notch and insert configuration. These figures depict versions of an interface 556, 556', 556" between a valve plate 334, 334' and the spool 342, 342', 342" when in the closed position. The interface 556, 556', 556" is formed by sealing portions 346, 346' in the valve plate 334, 334' that are engageable with end 348, 348', 348" of the spool 342, 342', 342"

Multiple sealing portions 346 in the form of grooves (or teeth) are shown in FIG. 5A. The sealing portions 346 may be a plurality of recesses with a plurality of raised portions therebetween positionable adjacent end 348 of the spool 342 as shown in FIG. 5A. One or more sealing interfaces 350 may be defined at the engagement point of each of the sealing portions 346 with the spool 342.

As shown in FIG. 5B, sealing portion 346' is in the form of a notch for receiving a key 546 extending from the end 348' of the spool 342. The key 546 may be matingly received in the notch at interface 350' for sealing therewith. Sealing interfaces 350' may be defined at the engagement point along the notch 346' with the key 546. The sealing portion 346' may be a notch as shown in FIG. 5C to receivingly engage an insert 546' of the end 348" of the spool 342. Sealing interfaces 350" may be defined at the engagement point along the insert 346' with the end 348 of the spool 342.

Other configurations of interface capable of providing a sealing interaction therebetween may be used. The grooves, key or notches may be, for example, a plurality of concentric rings providing sealing interaction 360 degrees about the valve plate and/or the spool to form a continuous seal thereabout. Multiple sealing interfaces 350, 350', 350" may be provided along the valve plate 334, 334' and the spool 342, 342' for redundant sealing therebetween. While FIGS. 5A-5C depict specific geometries and configurations of grooves, keys, notches and sealing interfaces, a variety of shapes may be used to generate the multiple interfaces and the redundant sealing.

The valve plate 334 can be made of a softer metal than a metal used on the spool 342 to provide elastic deformation of the sealing portions 346, 346' as they are pressed against the spool 342, 342', 342" and form a plurality of seals therewith. The sealing portions may be used to create a stress concentration at a point of contact of the sealing portion 346, 346' with the end 348, 348', 348" of the spool 342. The ends 348, 348', 348" may be similar, except that a portion, such as key 546 or insert 546", may extend a distance further from the ends 348, 348', 348".

Selectively at least one of the sealing portions 346, 346' may contact the spool 342 to form at least one interface at one or more high stress concentration points. As shown, for example, in FIG. 5C, multiple contact points may be used to provide one or more sealing interfaces 350" along an inner and/or outer portion of the sealing portion 346'. The shape of the sealing portion 346, 346' and/or end 348, 348', 348" may be defined (e.g., round, flat, polygonal, etc) to facilitate sealing interaction therebetween. The configuration may be defined to provide increased stress at contact points between the valve plate and the spool.

Figure 6A:
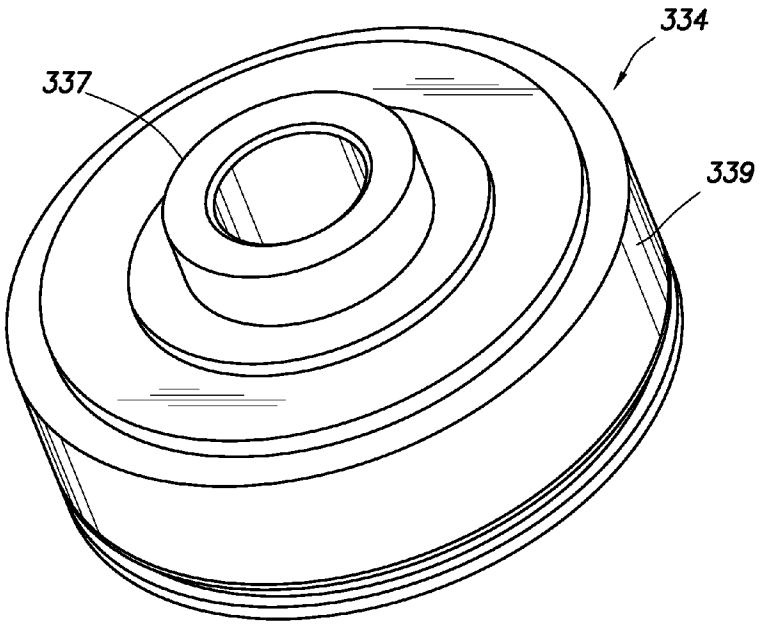
FIGS. 6A-6C depict perspective, plan views and cross-sectional views, respectively, of a valve plate.
Figure 6B:
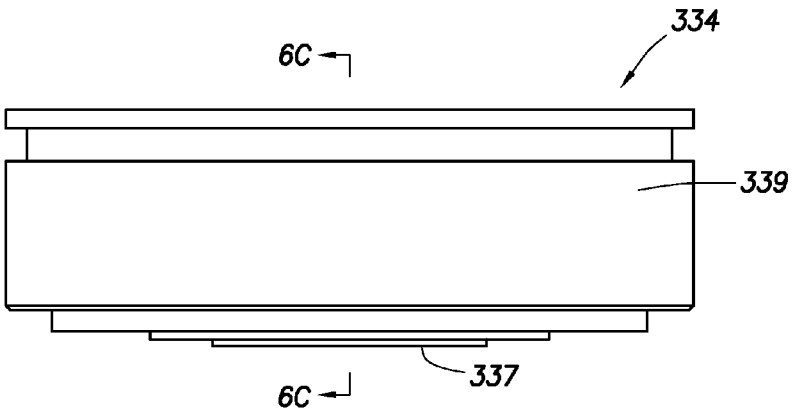
Figure 6C:
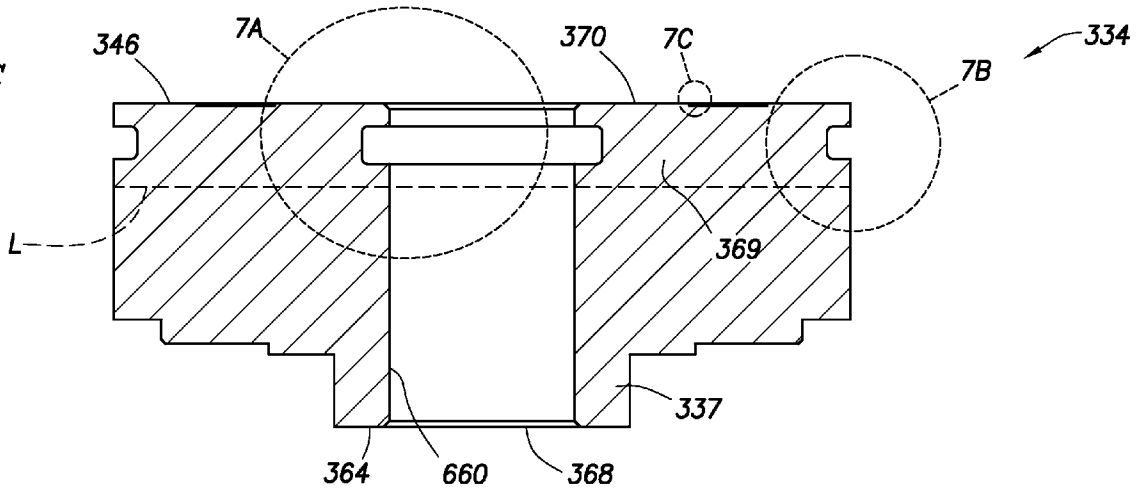
Figure 7C:
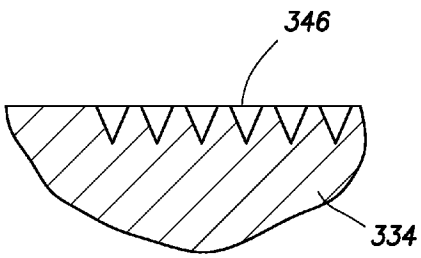
FIGS. 7A-7C are detailed views of portions of the valve plate of FIG. 6C.
Figure 7B:
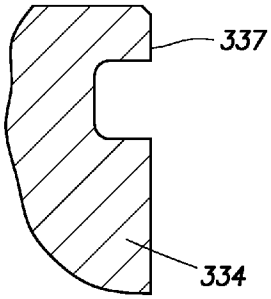
Figure 7A:
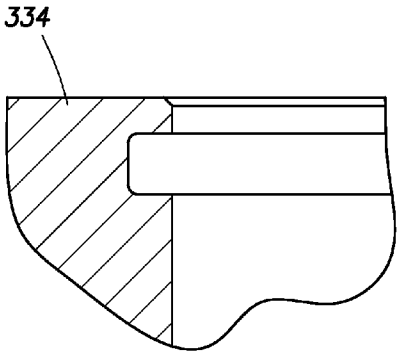

FIGS. 6A-7C show various views of the valve plate 334. FIGS. 6A-6C show perspective, plan, and longitudinal, cross-sectional views of the valve plate 334. FIGS. 7A-7C show portions of 7A-7C, respectively, of FIG. 6C of the valve plate 334 in greater detail. These figures show the valve plate 334 with the plate head 337 and plate ring 339 formed unitarily. Part or all of the valve plate 334 may be metal, composite, polymer or other material. In an example configuration, part or all of the valve plate 334 (e.g., a portion along sealing portion 346) may be metal to provide a metal-to-metal seal with the spool 342 (see, e.g., FIG. 3B).

The valve plate 334 may be formed of one or more portions, for example, with the plate head 337 and the plate ring 339 as separate pieces as indicated by line L. The valve plate 334 and/or other portions of the valve 115 may be modular, for example, for repair and/or replacement of portions thereof.

The valve plate 334 has a hole 660 therethrough shaped for slidingly receiving the piston rod 344 therethrough (see, e.g., FIG. 3B). The plate head 337 may be provided with a raised portion 364 on a spring surf 368 thereof for supportingly receiving the spring 335. An o-ring shoulder 339 is provided to receivingly engage the o-ring 335. A spool (or sealing or control fluid wetted) surface 370 of the valve plate 342 has the sealing portions 346 thereon. The spool surface 370 is positionable against a plate end 348 of the spool 342 (see, e.g., FIG. 3B).

Figure 8B:
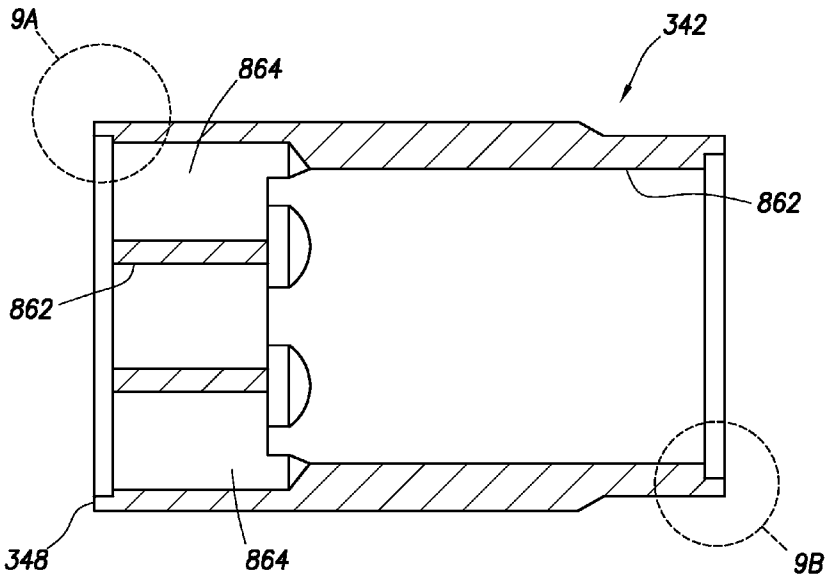
FIGS. 8A and 8B are end and longitudinal cross-sectional views, respectively, of a spool.
Figure 9B:
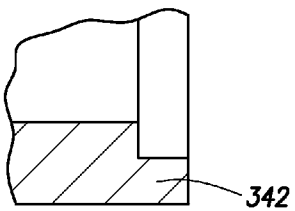
FIGS. 9A and 9B are detailed views of portions of the spool of FIG. 8B.
Figure 9A:
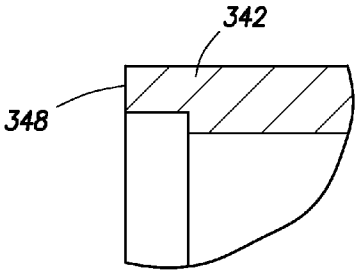
Figure 8A:
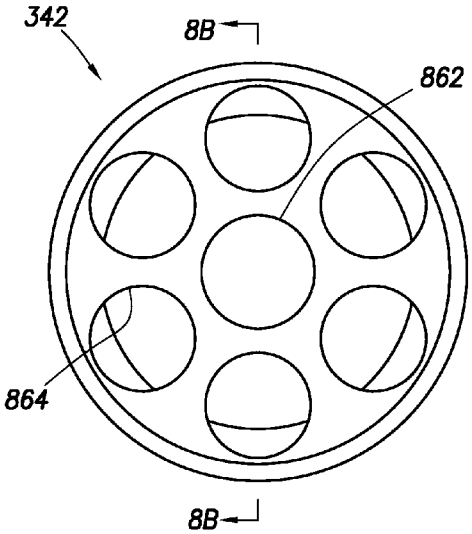

FIGS. 8A-8B depict end and cross-sectional views of the spool 342. FIG. 8B is a longitudinal, cross-sectional view of FIG. 8A taken along line 8B-8B. FIGS. 9A and 9B show detailed views of portions 9A and 9B, respectively, of the spool 342. These views show the spool 342 with the passage 862 for receiving the piston rod 344 (see, e.g., FIG. 3B), and holes 864 for the passage of fluid therethrough. As shown in these views, the end 348 of the spool 342 is positionable adjacent the sealing portions 346 of the valve plate 334 (see, e.g., FIG. 3B).

Figure 10A:
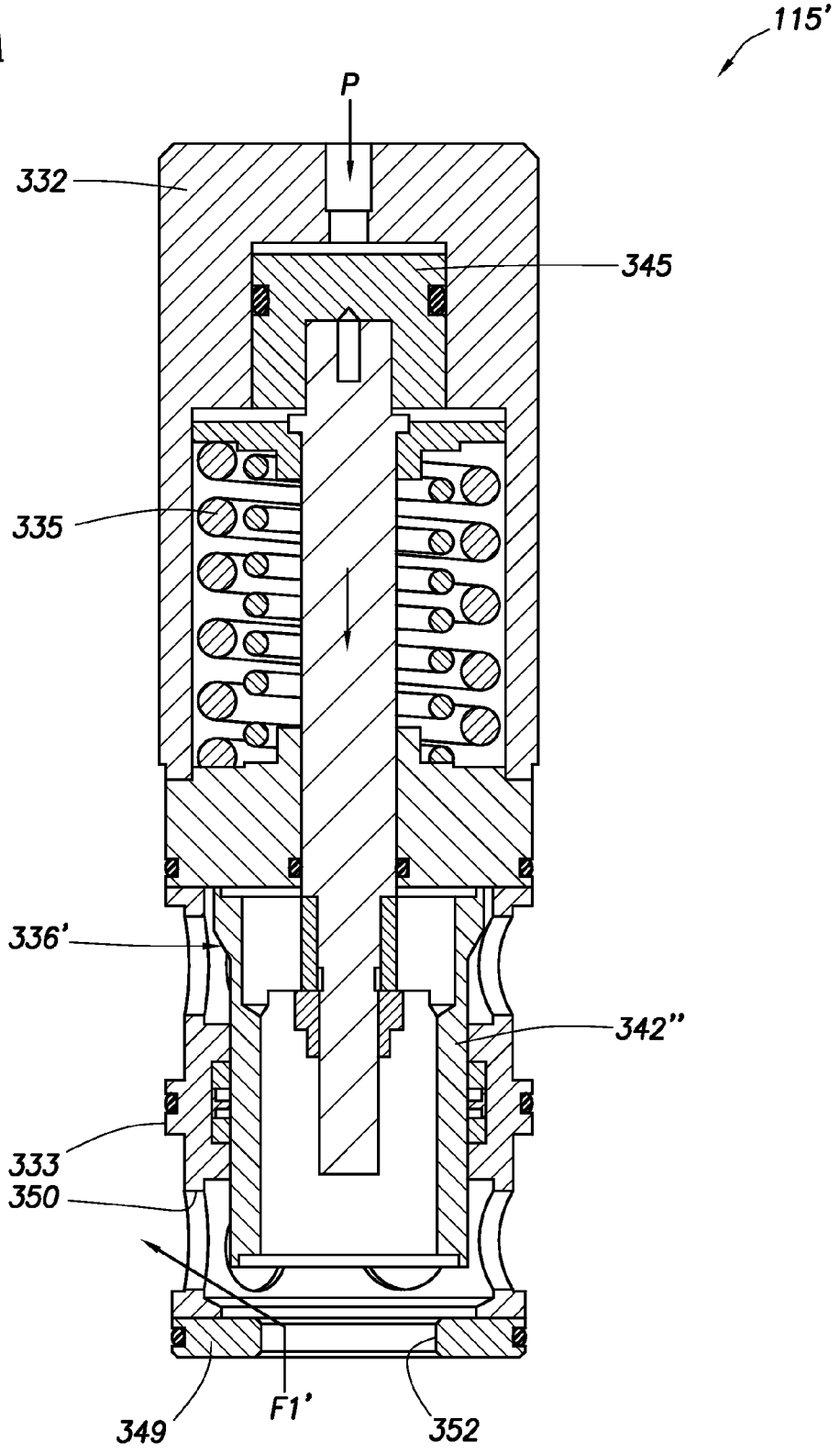
FIGS. 10A and 10B are vertical cross-sectional views of another sealable valve in a closed and an open position, respectively.
Figure 10B:
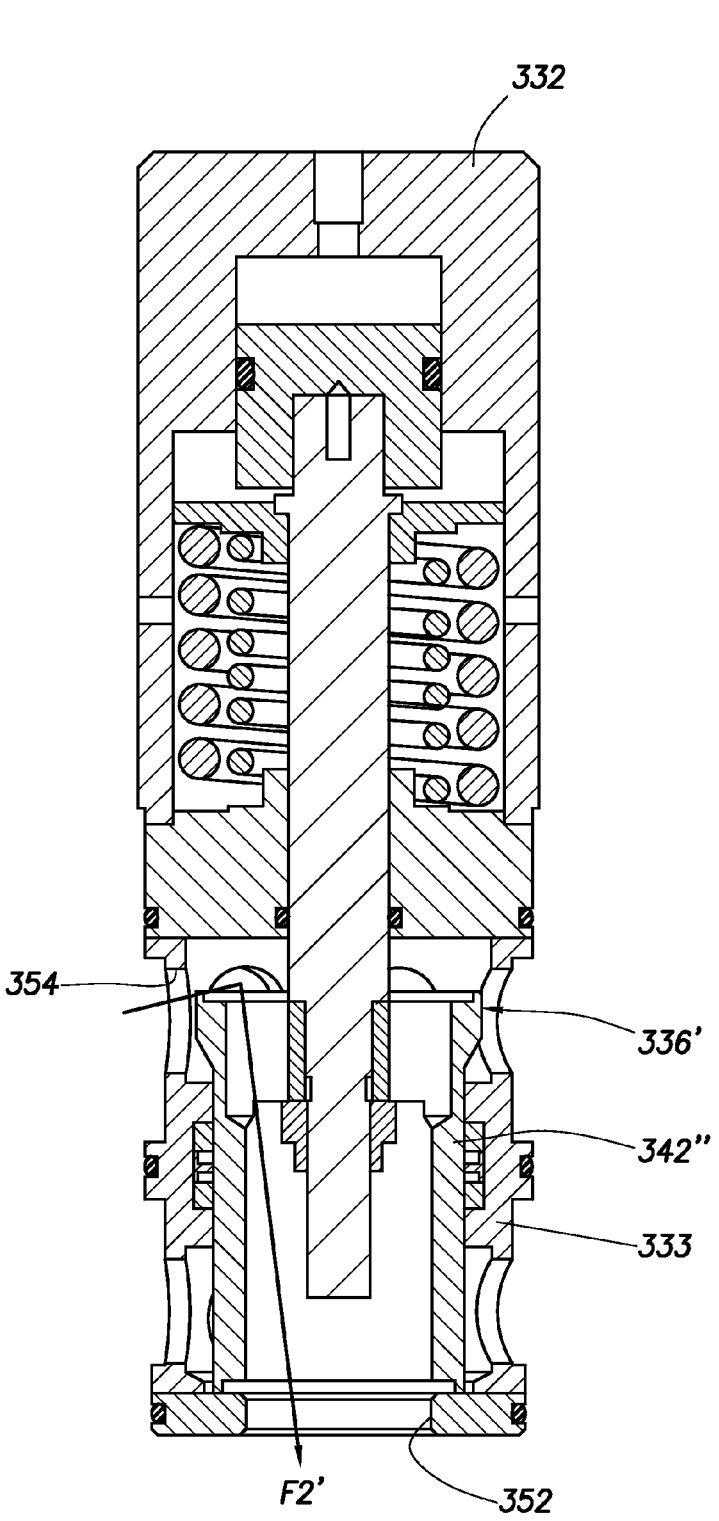

FIGS. 10A and 10B depict cross-sectional views of another version of another sealable valve 115' in a closed (sealed) and an open (unsealed) position, respectively. The sealable valve 115' is the same as the sealable valve 115, except that the sealable valve 115' has a spool assembly 336' with a spool 342" in the cage 333. This sealable valve 115' is urged to the closed position by spring(s) 335.

In the closed position of FIG. 10A, fluid flows through passage 352 and out of the cage 333 via outlets 350 as indicated by arrow F1'. Pressure P applied to pilot piston 345 moves the spool assembly 336' to the open position. In the open position of FIG. 10B, fluid flows in through inlets 354, through spool 342" and out passage 352 extending through the cage plate 349 of the cage 333 as indicated by arrow F2'. Pressure may be released to permit the spool assembly 336' to return to the closed position of FIG. 10A.

Figure 11A:
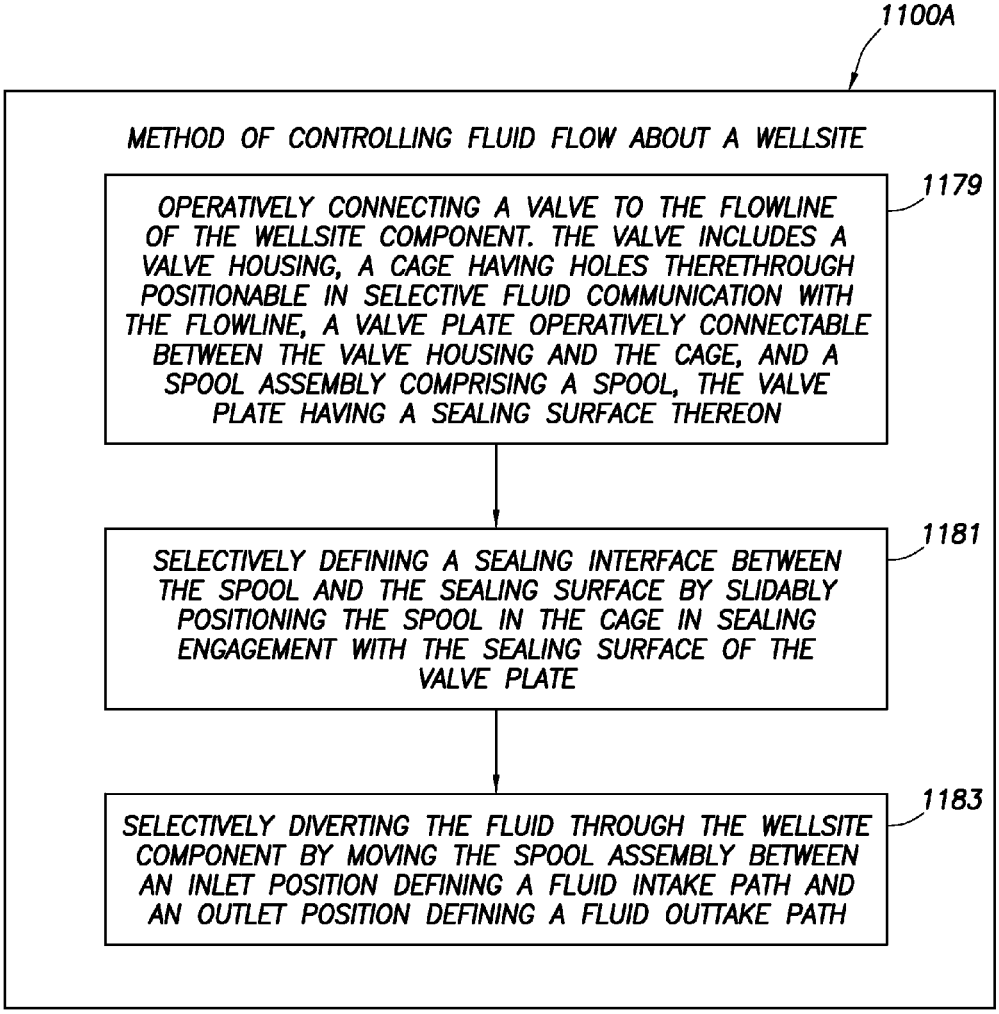
FIGS. 11A and 11B are flow charts depicting a method of controlling fluid flow about a wellsite and a method of selectively providing fluid to a wellsite component, respectively.

FIG. 11A shows a flow chart of a method 1100*a*, of controlling flow of fluid about a wellsite. The method 1100 involves 1179—operatively connecting a valve to the flowline of the wellsite component. The valve includes a valve housing, a cage having holes therethrough positionable in selective fluid communication with the flowline, a valve plate operatively connectable between the valve housing and the cage, and a spool assembly comprising a spool, the valve plate having a sealing surface thereon. The method 1100 also involves 1181—selectively defining a sealing interface between the spool and the sealing surface by slidably positioning the spool in the cage in sealing engagement with the sealing surface of the valve plate, and 1183—selectively diverting the fluid through the wellsite component by moving the spool assembly between an inlet position defining a fluid intake path and an outlet position defining a fluid outtake path.

Figure 11B:
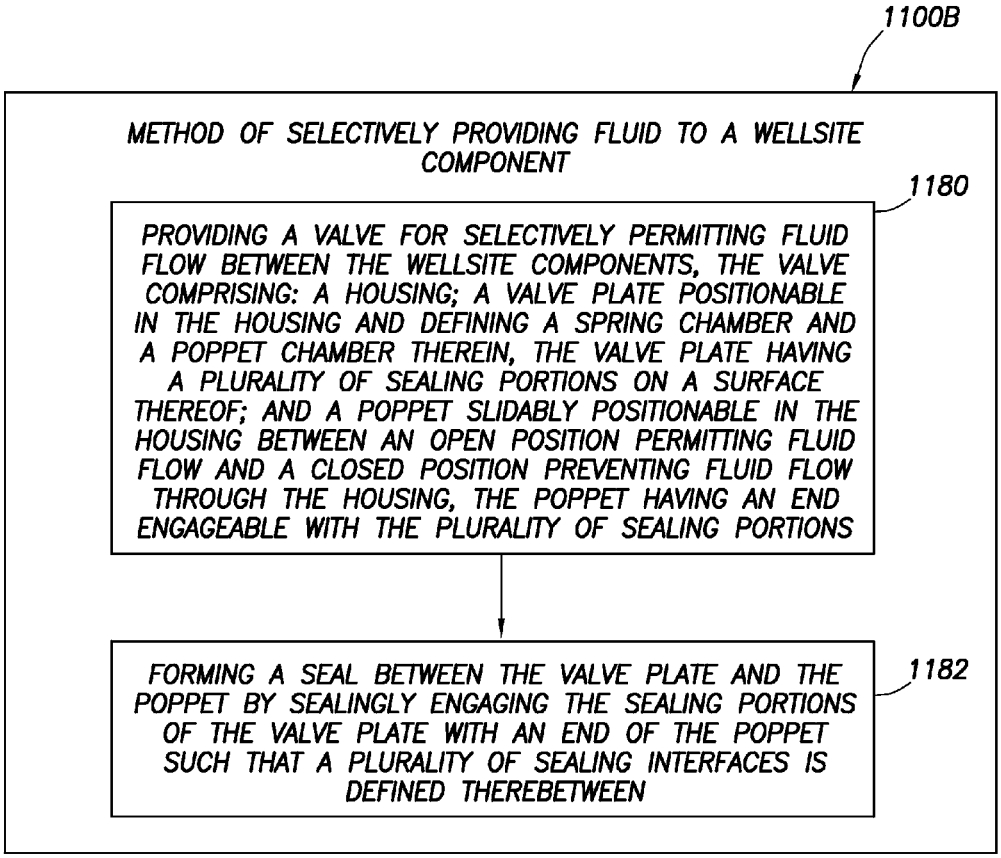

FIG. 11B shows a flow chart of a method 1100*b* of selectively providing fluid to a wellsite component. The method 1100*b* may involve 1180—providing a valve for selectively permitting fluid flow between components. The valve includes a housing, a valve plate and a spool. The valve plate is positionable in the housing and defining a spring chamber and a spool chamber therein, and has a plurality of sealing portions on a surface thereof. The spool is slidably positionable in the cage between an open position permitting fluid flow (and preventing venting) and a closed position preventing fluid flow (and allowing venting) through the spool, and has an end engageable with the plurality of sealing portions. The method also involves 1182—forming a seal between the valve plate and the spool by sealingly engaging the sealing portions of the valve plate with an end of the spool such that a plurality of sealing interfaces is defined therebetween.

The method may be performed in any order and repeated as desired.

While the subject matter has been described with respect to a limited number of embodiments, those skilled in the art, having benefit of this disclosure, will appreciate that other embodiments can be devised which do not depart from the scope of the subject matter as disclosed herein. Accordingly, the scope of the invention should be limited only by the attached claims.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and/or other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

The above description is illustrative of the preferred embodiment and many modifications may be made by those skilled in the art without departing from the invention whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible. For example, one or more valves with various configurations of valve plates having one or more types of sealing portions defining various interfaces may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A valve for controlling flow of fluid about a wellsite component of a wellsite, the wellsite component having a flowline to pass the fluid therethrough, the valve comprising:

a valve housing;

a cage having holes therethrough positionable in selective fluid communication with the flowline;

a valve plate operatively connectable between the valve housing and the cage, the valve plate having a sealing surface thereon with at least one recess therein; and a spool assembly comprising a spool slidably positionable in the cage, the spool assembly having an end engageable with the at least one recess to form a seal therewith, the spool assembly selectively positionable in sealing engagement with the sealing surface of the valve plate to define a metal-to-metal sealing interface therebetween, the spool assembly movable between an inlet position defining a fluid intake path and an outlet position defining a fluid outtake path whereby the fluid is selectively diverted through the wellsite component.

2. The valve of claim 1, wherein the spool assembly comprises a piston rod operatively connectable to the spool, the piston rod extending through the valve plate.

3. The valve of claim 2, further comprising a pilot piston operatively connectable to the piston rod, the pilot piston slidably positionable in the valve housing.

4. The valve of claim 1, wherein the at least one recess comprises at least one groove.

5. The valve of claim 1, wherein the at least one recess comprises a notch.

6. The valve of claim 5, wherein an end of the spool defines one of a key and an insert receivable by the notch.

7. The valve of claim 1, wherein the sealing surface and the spool comprise metal and wherein the sealing interface comprises a metal to metal seat.

8. The valve of claim 1, wherein at least a portion of the sealing surface comprises metal.

9. The valve of claim 1, wherein the valve plate is modular.

10. The valve of claim 1, wherein the valve housing has a pressure inlet extending therein.

11. The valve of claim 10, wherein the valve housing has a pilot cavity extending therein from the pressure inlet, a pilot piston slidably positionable in the pilot cavity.

12. The valve of claim 10, wherein the spool assembly comprises a piston rod with a pilot piston slidably movable in the pressure inlet.

13. The valve of claim 12, further comprising a spring disposable in the housing about the pilot piston, the spring urging the spool assembly toward the housing.

14. The valve of claim 13, wherein the spring comprises an inner spring and an outer spring.

15. The valve of claim 12, wherein the spool comprises a tubular portion having a ring therein to receivably engage the piston rod.

16. The valve of claim 1, wherein the spool has a flow end selectively positionable in sealing engagement with the cage to selectively divert the flow through the passage and one of the cage and the spool.

17. The valve of claim 1, wherein the holes comprise at least one inlet, at least one outlet, and a passage therethrough.

18. The valve of claim 17, wherein the cage has a cage seal therein engageable with the spool to isolate the at least one inlet from the at least one outlet.

19. The valve of claim 17, wherein the fluid intake path extends in the at least one inlet and out the passage of the cage.

20. The valve of claim 17, wherein the fluid outtake path extends in the passage and out the at least one outlet.

21. The valve of claim 17, wherein the fluid outtake path extends in the passage, through the cage, and out the at least one outlet.

22. The valve of claim 17, wherein the fluid intake path extends in the at least one outlet, through the cage, and out the passage.

23. The valve of claim 1, further comprising at least one t-seal, o-ring, and combinations thereof.

24. A hydraulic system of a wellsite, the hydraulic system having fluid flowing therethrough, the hydraulic system comprising:

a wellsite component having a flowline to pass the fluid therethrough; and a valve operatively connectable to the flowline, the valve comprising:

a valve housing;

a cage having holes therethrough positionable in selective fluid communication with the flowline;

a valve plate operatively connectable between the valve housing and the cage, the valve plate having a sealing surface thereon with at least one recess therein; and a spool assembly comprising a spool slidably positionable in the cage, the spool assembly having an end engageable with the at least one recess to form a seal therewith, the spool assembly selectively positionable in sealing engagement with the sealing surface of the valve plate to define a metal-to-metal sealing interface therebetween, the spool assembly movable between an inlet position defining a fluid intake path and an outlet position defining a fluid outtake path whereby the fluid is selectively diverted through the wellsite component.

25. The system of claim 24, further comprising a fluid source operatively connectable to the flowline.

26. The system of claim 24, wherein the wellsite component comprises one of a pod, a low marine riser package, a blowout preventer, and combinations thereof.

27. A method of controlling flow of fluid about a wellsite, the wellsite comprising a wellsite component comprising a flowline to pass the fluid therethrough, the method comprising:

operatively connecting a valve to the flowline of the wellsite component, the valve comprising a valve housing, a cage having holes therethrough positionable in selective fluid communication with the flowline, a valve plate operatively connectable between the valve housing and the cage, and a spool assembly comprising a spool, the valve plate having a sealing surface thereon with at least one recess therein;

selectively defining a metal-to-metal sealing interface between the spool and the sealing surface by slidably positioning an end of the spool in the cage in sealing engagement with the at least one recess of the sealing surface; and selectively diverting the fluid through the wellsite component by moving the spool assembly between an inlet position defining a fluid intake path and an outlet position defining a fluid outtake path.

28. The method of claim 27, wherein the sealing surface and the spool comprise metal and wherein the selectively defining comprises forming a metal-to-metal seal therebetween.

29. The method of claim 27, wherein the sealing surface comprises a plurality of grooves and wherein the selectively diverting comprises sealingly engaging the spool with the plurality of grooves.

30. The method of claim 27, wherein the sealing surface comprises a notch and wherein the selectively diverting comprises receivingly engaging a sealing end of the spool in the groove.

31. The method of claim 27, wherein the operatively connecting comprises operatively connecting together a plurality of portions of the valve plate.

32. The method of claim 27, further comprising urging a piston to a pilot end of the housing.

33. The method of claim 27, wherein the selectively diverting comprises passing the fluid in the at least one inlet and out a passage of the cage.

34. The method of claim 27, wherein the selectively diverting comprises passing the fluid in the passage and out the at least one outlet.

35. The method of claim 27, wherein the selectively diverting comprises passing the fluid in the passage, through the cage, and out the at least one outlet.

36. The method of claim 27, wherein the selectively diverting comprises passing the fluid in the at least one outlet, through the cage, and out the passage.

37. The method of claim 27, further comprising activating at least one additional wellsite component.

38. A valve for controlling flow of fluid about a wellsite component of a wellsite, the wellsite component having a flowline to pass the fluid therethrough, the valve comprising:

a valve housing;

a cage having holes therethrough positionable in selective fluid communication with the flowline;

a valve plate operatively connectable between the valve housing and the cage, the valve plate having a sealing surface thereon, the sealing surface comprising a notch; and a spool assembly comprising a spool slidably positionable in the cage, the spool assembly having an end defining one of a key and an insert receiveable by the notch and selectively positionable in sealing engagement with the sealing surface of the valve plate to define a sealing interface therebetween, the spool assembly movable between an inlet position defining a fluid intake path and an outlet position defining a fluid outtake path whereby the fluid is selectively diverted through the wellsite component.

* * * * *